US009807844B2

(12) United States Patent
Hori

(10) Patent No.: US 9,807,844 B2
(45) Date of Patent: Oct. 31, 2017

(54) LED MODULE

(71) Applicants: CITIZEN WATCH CO., LTD., Tokyo (JP); CITIZEN ELECTRONICS CO., LTD., Yamanashi (JP)

(72) Inventor: Takahiro Hori, Yamanashi (JP)

(73) Assignees: CITIZEN WATCH CO., LTD., Tokyo (JP); CITIZEN ELECTRONICS CO., LTD., Yamanashi (JP)

( * ) Notice: Subject to any disclaimer, the term of this patent is extended or adjusted under 35 U.S.C. 154(b) by 0 days.

(21) Appl. No.: 15/434,441

(22) Filed: Feb. 16, 2017

(65) Prior Publication Data

US 2017/0238389 A1 Aug. 17, 2017

(30) Foreign Application Priority Data

Feb. 16, 2016 (JP) ..... 2016-026839

(51) Int. Cl.
*H05B 33/08* (2006.01)

(52) U.S. Cl.
CPC ..... *H05B 33/0857* (2013.01); *H05B 33/089* (2013.01); *H05B 33/0827* (2013.01); *H05B 33/0845* (2013.01)

(58) Field of Classification Search
CPC .... H05B 37/02; H05B 33/08; H05B 33/0827; H05B 33/0845; H05B 33/0857; H05B 33/089
USPC ..... 315/209 R, 224–226, 291, 307, 308, 312
See application file for complete search history.

(56) References Cited

U.S. PATENT DOCUMENTS 6,753,653 B2 * 6/2004 Wendt ..... G09G 3/296 315/161

FOREIGN PATENT DOCUMENTS

JP 2012-113959 A 6/2012

* cited by examiner

*Primary Examiner* — Jimmy Vu

(57) ABSTRACT

An LED module includes, on a circuit board, first to fourth electrodes, a first circuit including a first LED group, and a second circuit including second and third LED groups, a switch element and a detection element. The second circuit includes a first path leading from the second LED group to one end of the detection element, and a second path leading from the third LED group via the switch element to one end of the detection element. The first and second electrodes are connected to the first circuit, the third electrode is connected to the second and third LED groups, and the fourth electrode is connected to the other end of the detection element. The threshold voltage for light emission of the second LED group is larger than that of the third LED group. The switch element controls a current flowing through the second path in accordance with a current flowing via the detection element.

7 Claims, 6 Drawing Sheets

LED MODULE

CROSS REFERENCE TO RELATED APPLICATION

This application is a new U.S. patent application that claims benefit of JP2016-026839, filed on Feb. 16, 2016. The entire contents of JP2016-026839 are hereby incorporated by reference.

TECHNICAL FIELD the present invention relates to an LED module capable of carrying out dimming in conjunction with color mixing.

BACKGROUND

Lighting devices capable of adjusting their emission color are on the market. In these lighting devices, LEDs (light-emitting diodes) are used as a light source, and the light source unit is sometimes modularized (Such light source unit is hereinafter referred to as "LED module."). As is well known, an arbitrary emission color can be obtained at an arbitrary light emission intensity, by preparing an LED emitting red light, an LED emitting green light, and an LED emitting blue light and adjusting the emission intensity of each of the LEDs.

For natural illumination light, an emission color near the blackbody radiation locus is preferable. In other words, a high color temperature is selected for increasing light brightness, and a low color temperature is selected for dimming light. Color temperature can be varied along the blackbody radiation locus by adjusting the intensity of each two prepared LEDs emitting light at different color temperatures on the blackbody radiation locus (see, for example, Japanese Unexamined Patent Publication (Kokai) No. 2012-113959 (hereinafter referredto as Patent Literature 1)).

FIG. 8 is a circuit diagram of a lighting device (light-emitting device 1) described in Patent Literature 1. As illustrated in FIG. 8, the light-emitting device 1 includes LEDs 2 as a light source, a chromaticity-setting unit 3 for setting a certain chromaticity, and a control unit 4 for dimming the light output from the LEDs 2 to the chromaticity set by the chromaticity-setting unit 3. As the LEDs 2, two types of LEDs 2*a* and 2*b* each emitting light of a different chromaticity are used. The LEDs 2*a* emit light at a lower color temperature, and the LEDs 2*b* do at a higher color temperature.

The chromaticity-setting unit 3 includes a volume controller 31 which generates color temperature information so that, in dimming operation, when the light output is small, the light-emitting device 1 emits light having a lower color temperature, and the light-emitting device 1 emits light having gradually elevating color temperature as the intensity of the light output increases. The chromaticity-setting unit 3 calculates a chromaticity point on the blackbody radiation locus based on the color temperature information from the volume controller 31 and outputs a duty signal including control information to the control unit 4. The control unit 4 applies a voltage for dimming control to the LEDs 2*a* and 2*b* based on the duty signal. The control unit 4 is incorporated in a power supply unit (not illustrated) that turns on the light-emitting device 1.

FIG. 9 is a graph illustrating a light emission characteristic of the light-emitting device 1 illustrated in FIG. 8. In FIG. 9, chromaticity points of the LEDs 2*a* and 2*b* are indicated by 2*a* and 2*b*. The set color temperature of the LEDs 2*a* is 2,500 K, and the chromaticity point 2*a* of the LEDs 2*a* is on the blackbody radiation locus L. The set color temperature of the LEDs 2*b* is 5,000 K, and the chromaticity point 2*b* of the LEDs 2*b* is positively deviated for both x and y values with respect to coordinates corresponding to the set color temperature on the blackbody radiation locus L. A line segment (2*a*-2*b*) on the chromaticity diagram connecting the chromaticity points 2*a* and 2*b* in the figure is close to the blackbody radiation locus L. The light emission color of the light-emitting device 1 is determined by a ratio of the light emission amount of the LEDs 2*a* to that of the LEDs 2*b* and falls on a point on the line segment (2*a*-2*b*).

In FIG. 9, the deviation duv of the chromaticity point 2*b* (distance from the blackbody radiation locus L) is set to be larger than that of the chromaticity point 2*a*. The reason is that, when a current increases, the chromaticity point 2*b* (x and y values of the chromaticity coordinates) of the LEDs 2*b* is expected to negatively shift like a chromaticity point 2*b*′. Thus, the emission color of the light-emitting device 1 varies within a range indicated by a broken line W (2*a*-2*b*′) in the figure, i.e., within a range more close to the blackbody radiation locus L.

In the light-emitting device 1, an LED module is configured by a light-emitting unit (board 5) in which conductive patterns 41*a*, 41*b*, 51*a*, and 51*b* are formed on a board 5 and the LEDs 2*a* and 2*b* are mounted thereon (see FIG. 8). In other words, Patent Literature 1 can provide an LED module configuring, in combination with the chromaticity-setting unit 3 and the control unit 4, a lighting device (light-emitting device 1) illuminating naturally and comfortably.

SUMMARY

As illustrated in FIG. 9, the blackbody radiation locus is a curve. In contrast, in the lighting device (light-emitting device 1) illustrated in FIG. 8, the emission color varies on the line segment (2*a*-2*b*) or the line segment W (2*a*-2*b*′). In other words, since the LED module (light-emitting unit (board 5)) is provided with only the LEDs 2*a* and 2*b* having two different emission colors, the lighting device (light-emitting device 1) using the LED module can vary the emission color only linearly within a narrow range of color temperature near the blackbody radiation locus.

When the LED module includes three LEDs having three different emission colors, the LED module can emit light in an arbitrary intensity with a chromaticity within a region surrounded by the emission colors (chromaticity points) of the three LEDs. In other words, the emission color of the LED module can be curved along the curvilinear blackbody radiation locus. However, when three LEDs having different emission colors are prepared and the light emission intensities of the respective LEDs are to be controlled independently, a lighting device using the LED module suffers increase in the number of power supplies, control circuits, and conductive patterns, and complication of its control program.

The present invention has been made in view of the above problems. It is an object of the present invention to provide an LED module that can vary, during dimming operation, the emission color curvilinearly along the blackbody radiation locus without increase in the number of power supplies, etc., of the lighting device and the size of the control program.

Provided is an LED module including a circuit board, a first light-emitting circuit which includes a first LED group emitting light in a first color, and is mounted on the circuit board, a second light-emitting circuit which includes a second LED group emitting light in a second color, a third LED group emitting light in a third color, a switch element, and a current detection element, and is mounted on the circuit board, and a first electrode, a second electrode, a third electrode, and a fourth electrode which are formed on the circuit board, wherein the second light-emitting circuit includes a first current path through which a current output from the second LED group is input to one end of the current detection element, and a second current path through which a current output from the third LED group passes via the switch element and is input to one end of the current detection element, the first electrode and the second electrode are connected to the first light-emitting circuit, the third electrode is connected to the second LED group and the third LED group, the fourth electrode is connected to the other end of the current detection element, a threshold voltage for light emission of the second LED group is set to be larger than a threshold voltage for light emission of the third LED group, and the switch element controls a current flowing through the second current path in accordance with a current flowing via the current detection element.

Preferably, in the second light-emitting circuit of the above LED module, when a supply current supplied between the third electrode and the fourth electrode is in a first current region, a current flows only through the second current path, so that only the third LED group is turned on, when the supply current is in a second current region larger than the first current region, the current flows through the first current path and the second current path, so that both of the second LED group and the third LED group are turned on, and when the supply current is in a third current region larger than the second current region, the current flowing through the second current path is limited by the switch element, and thereby the current flows only through the first current path, so that only the second LED group is turned on.

Preferably, in the above LED module, the first color and the second color has a chromaticity point which is on a blackbody radiation locus, and the third color has a chromaticity point an x coordinate of which is between that of the chromaticity point of the first color and that of the chromaticity point of the second color and a y coordinate of which is higher than that of the blackbody radiation locus.

Preferably, in the above LED module, a fourth LED group is inserted between the third electrode and a connection point of the second LED group and the third LED group.

Preferably, the above LED module further includes a current-limiting circuit provided between the second LED group and the current detection element in the first current path.

Preferably, the above LED module further includes a resistor provided between the switch element and the current detection element in the second current path.

Further, provided is a method of controlling the above LED module, including inputting, when the supply current is in the first current region, a current in an amount corresponding to the supply current to the first light-emitting circuit, so that the first LED group emits light, circulating, when the supply current is in the second current region, a current through the first light-emitting circuit, the current driving the first LED group to emit light at an intensity such that an emission color of the LED module is on an intersection of the blackbody radiation locus and a line segment connecting chromaticity points of the first color and an emission color of the second light-emitting circuit in a chromaticity diagram, and decreasing, when the supply current is in the third current region, the current flowing through the first light-emitting circuit, so that the first LED group is turned off.

The above LED module can vary, during dimming operation, the emission color curvilinearly along the blackbody radiation locus without increase in the number of power supplies, etc., of the lighting device and the size of the control program.

BRIEF DESCRIPTION OF THE DRAWINGS

Other features and advantages of the present invention will be apparent from the ensuing description, taken in conjunction with the accompanying drawings, in which.

DESCRIPTION

Figure 1:
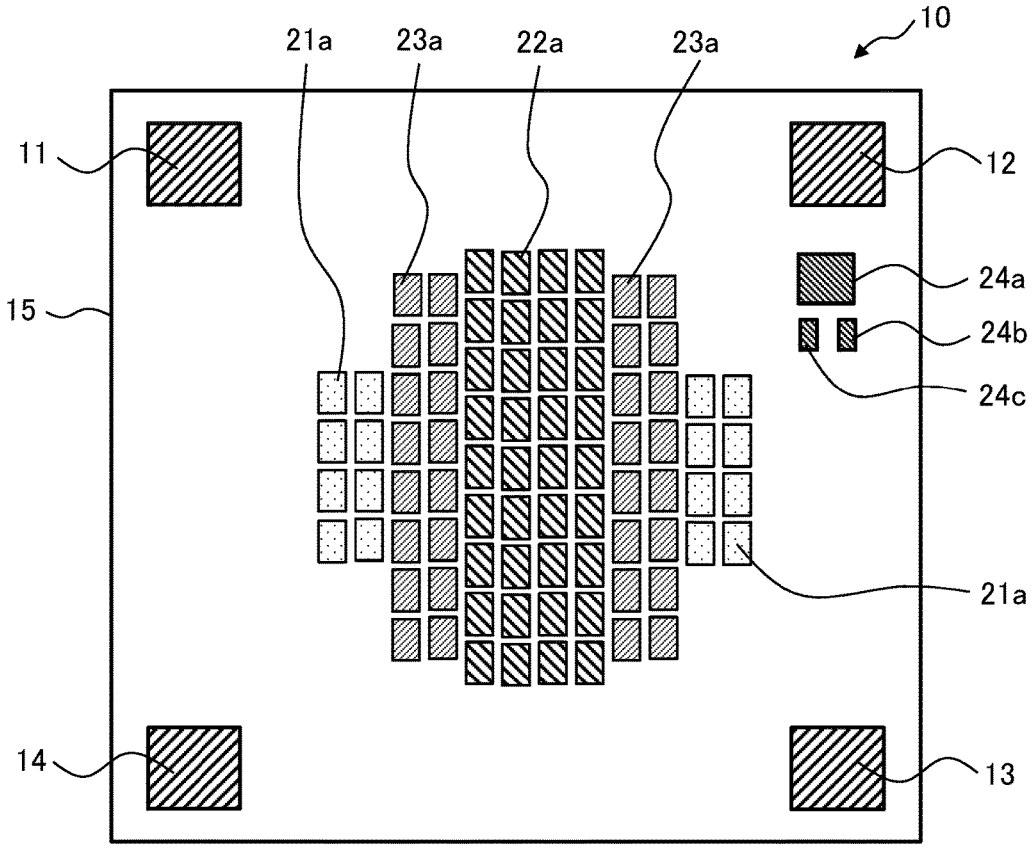
FIG. 1 is a plan view of an LED module 10.

Preferable embodiments of the present invention will be described in detail with reference to drawings. In the description of the drawings, the same or equivalent elements will be denoted by the same reference numerals, and redundant description will be omitted. Further, matters specifying the invention in the claims and corresponding to the elements in the drawings are mentioned in parentheses.

FIG. 1 is a plan view of an LED module 10. As illustrated in FIG. 1, the LED module 10 includes a circuit board 15, and LEDs 21*a* emitting light in a first color, LEDs 22*a* emitting light in a second color, LEDs 23*a* emitting light in a third color, an FET 24*a* (switch element), a resistor 24*b* (current detection element), and a resistor 24*c*, mounted on the circuit board. Further, an electrode 11 (first electrode), an electrode 12 (second electrode), an electrode 13 (third electrode), and an electrode 14 (fourth electrode) are formed at the four corners of the circuit board 15. In addition, conductive patterns (not illustrated) are formed on the circuit board 15.

As a material for the circuit board 15, for example, ceramics or aluminum having undergone insulation treatment on its surface is selected based on thermal conductivity and reflectance. Since there is no through hole in the circuit board 15, the conductive patterns are formed only on the upper surface. In the LED module 10, LEDs 21*a*, 22*a*, 23*a*, etc., are arranged so that a circuit described later (see FIG. 3) can be configured by using the conductive patterns only on the upper surface of the board. However, since conductive patterns can also be formed on the lower surface of the circuit board by using through holes, the LEDs 21*a*, 22*a*, and 23*a* can be arranged in a patchy pattern, or the FET 24*a*, the electrodes 11 to 14, etc., can be arranged on the lower surface of the circuit board.

Each group of the LEDs 21*a*, 22*a*, and 23*a* is arranged so as to configure a series (series-parallel) circuit. Further, the LEDs 21*a*, 22*a*, and 23*a* are provided with protruding electrodes 19 on the lower surfaces thereof (see FIG. 2), and are directly connected to the conductive patterns formed on the upper surface of the circuit board 15 by the protruding electrodes 19. The LEDs 21*a* are connected in series (series-parallel) to configure a first LED group 21 (In the figure, two LEDs 21*a* adjacent from side to side are connected in parallel and two pairs of LEDs 21*a* adjacent in the perpendicular direction are connected in series. Hereinafter, the series-parallel circuit is simply referred to as a series circuit). The first LED group 21 has 18 series stages, and configures a first light-emitting circuit 41 (see FIG. 3). Similarly, the LEDs 22*a* and the LEDs 23*a* are each connected in series to configure a second LED group 22 and a third LED group 23. The second LED group 22 and the third LED group 23 have 18 series stages and 16 series stages, respectively, and are included in a second light-emitting circuit 42 (see FIG. 3).

Figure 2:
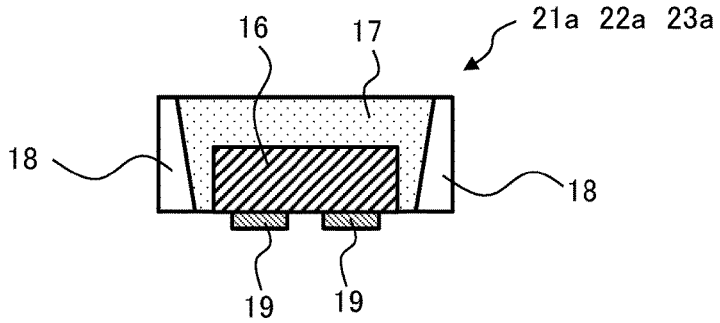
FIG. 2 is a cross-sectional view in the longitudinal direction of the LEDs 21*a*, 22*a*, and 23*a*.

FIG. 2 is a cross-sectional view in the longitudinal direction of the LEDs 21*a*, 22*a*, and 23*a*. Each of the LEDs 21*a*, 22*a*, and 23*a* include an LED die 16, protruding electrodes 19 formed on the lower surface of the LED die 16, a phosphor resin 17 covering the LED die 16, and a white reflective resin 18 surrounding the phosphor resin 17. The LED die 16 includes a semiconductor layer and a transparent board laminated thereon. The two protruding electrodes 19 are formed on the lower surface of the semiconductor layer, and one of the protruding electrodes 19 becomes an anode and the other a cathode. The phosphor resin 17 is a silicone resin containing a phosphor. The white reflective resin 18 is a silicone resin containing reflective fine particles such as titanium oxide and alumina. The LED die 16 emits blue light, and some of the blue light undergoes wavelength-conversion by the phosphor resin 17. The white reflective resin 18 is opposed to the side surfaces of the LED die 16 in such a way as to sandwich the phosphor resin 17 therebetween, and has a tapered internal side so as to redirect laterally-advancing light upward.

The emission colors of the LEDs 21*a*, 22*a*, and 23*a* differ from each other depending on the phosphor contained in the phosphor resin 17. The planar size of the LED die 16 is about 0.4 mm×0.7 mm. The periphery of the LED die 16 is covered with a thickness of about 0.15 mm, and therefore the planar size of the LEDs 21*a*, 22*a*, and 23*a* is about 0.7 mm×1.0 mm. The LEDs 21*a*, 22*a*, and 23*a* each have a planar size substantially equal to the planar size of the LED die 16, and therefore this configuration is called a chip size package (CSP).

The FET 24*a* and the resistors 24*b* and 24*c* may be a surface mounting component or a bare chip mounted by flip-chip bonding. Alternatively, a bare chip may be die-bonded and connected to the conductive pattern on the circuit board 15 with a wire. In the case of a bare chip, it is preferably molded with a white reflective resin containing titanium oxide or alumina.

Figure 3:
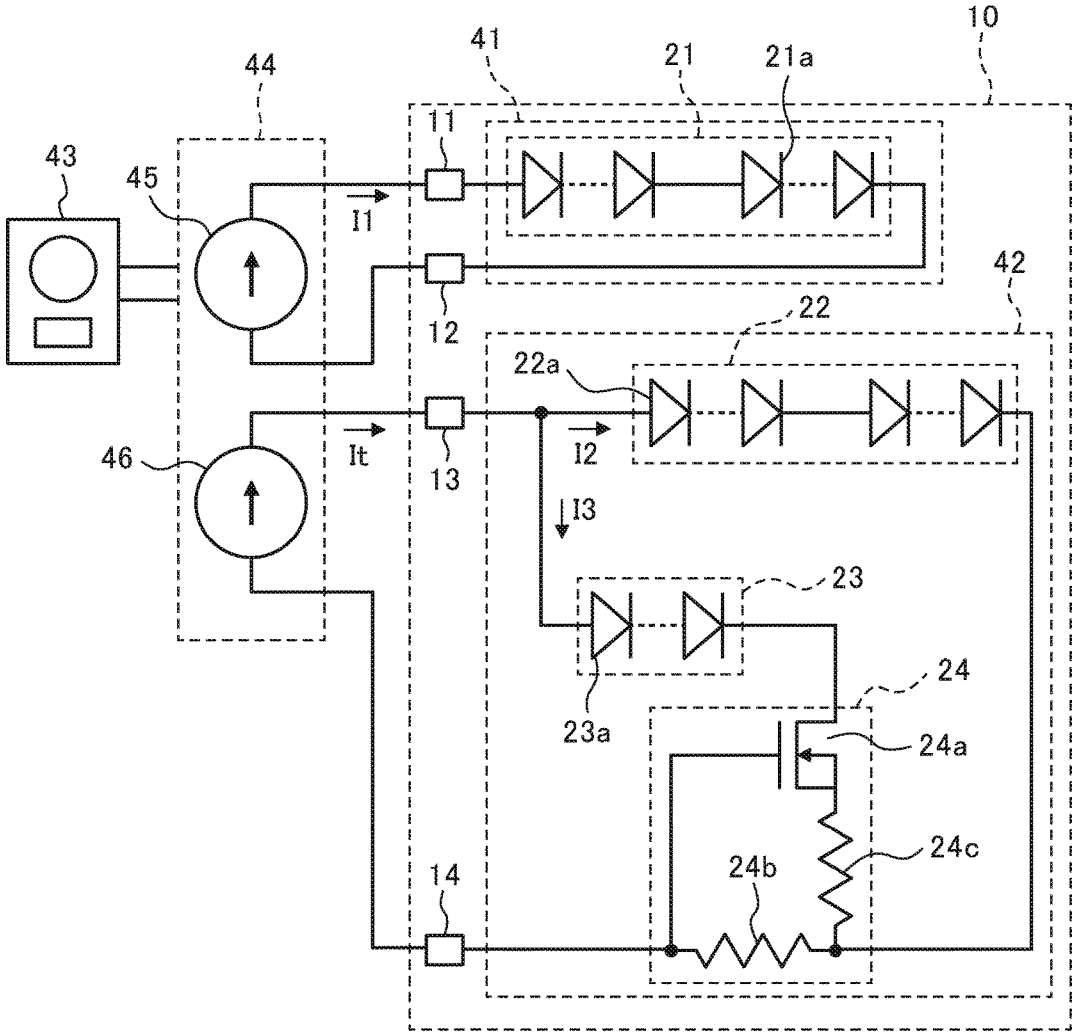
FIG. 3 is a circuit diagram of the LED module 10.

FIG. 3 is a circuit diagram of the LED module 10. For explanatory convenience, FIG. 3 illustrates a configuration of a lighting device in which a dimmer 43 and a control unit 44 are added to the LED module 10. The dimmer 43 cuts out a part (phase) of an AC waveform obtained from a commercial AC power supply, and sends the cut signal to the control unit 44. The control unit 44 extracts electric power and information on dimming operation (information on the cut phase) from this signal. The control unit 44 determines a current value to be output from variable constant-current sources 45 and 46 based on the information on dimming operation. The variable constant-current sources 45 and 46 output the determined current to the LED module 10.

As illustrated in FIG. 3, the LED module 10 includes a first light-emitting circuit 41 and a second light-emitting circuit 42. The first light-emitting circuit 41 includes a first LED group 21. In the first LED group 21, the LEDs 21*a* are connected in series. An anode of the series circuit is connected to a current output terminal of the variable constant-current source 45 via the electrode 11, and a cathode thereof is connected via the electrode 12 to the other terminal of the variable constant-current source 45 to which the current returns. In other words, the first light-emitting circuit 41 is supplied with a current from the variable constant-current source 45 (first external power supply) via the electrode 11 and returns the current to the first external power supply via the electrode 12.

The second light-emitting circuit 42 includes the second LED group 22, the third LED group 23, and a switch circuit 24. In the second LED group 22, the LEDs 22*a* are connected in series. Similarly, in the third LED group 23, the LEDs 23*a* are connected in series. The switch circuit 24 includes the depletion-type FET 24*a* (switch element), the resistor 24*b* (current detection element), and the resistor 24*c*. The FET 24*a* serves to distribute a current to the second LED group 22 and the third LED group 23. The resistor 24*b* detects a current input to the second light-emitting circuit 42.

A cathode of the series circuit configuring the second LED group 22 is connected to one end of the resistor 24*b*, so that a first current path is formed between the cathode and the one end of the resistor 24*b*. A cathode of the series circuit configuring the third LED group 23 is connected to the drain of the FET 24*a*, and the source of the FET 24*a* is connected to the one end of the resistor 24*b* via the resistor 24*c*, so that a second current path is formed between the source and the one end of the resistor 24*b*. The other end of the resistor 24*b* is connected to the gate of the FET 24*a*.

The electrode 13 is connected to an anode of the series circuit configuring the second LED group 22 and an anode of the series circuit configuring the third LED group 23. The electrode 14 is connected to the other end of the resistor 24*b* and also to a terminal of the variable constant-current source 46 to which the current returns. In other words, the second light-emitting circuit 42 is supplied with a current from the variable constant-current source 46 (second external power supply) via the electrode 13 and returns the current to the variable constant current source 46 via the electrode 14.

Figure 4:
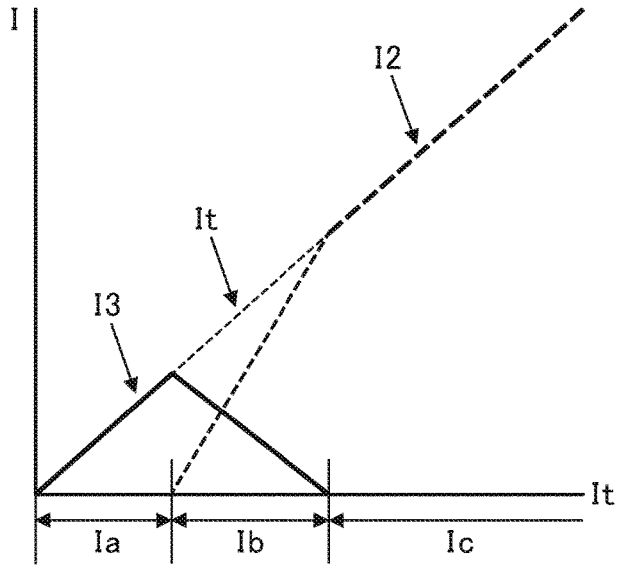
FIG. 4 is a diagram for explaining operation of the second light-emitting circuit 42.

FIG. 4 is a diagram for explaining operation of the second light-emitting circuit 42. In FIG. 4, the vertical axis I represents a current flowing through each unit, and the horizontal axis It represents a total current flowing into the second light-emitting circuit 42. Therefore, the total flowing current It is represented as a straight line passing through the origin and having a slope of 45° . I2 is a current flowing through the second light-emitting circuit 42, and I3 is a current flowing through the third LED group 23.

The number of the series stages of the LEDs 23*a* (16 stages) is smaller than that of the LEDs 22*a* (18 stages), and therefore a threshold voltage of the series circuit configuring the third LED group 23 (a voltage across the anode and the cathode, at which voltage the current begins to flow) is lower than that of the series circuit configuring the second LED group 22. Therefore, in a current region Ia (first current region) where the current It is small in FIG. 4, all the current It flowing into the second light-emitting circuit 42 will flow to the third LED group 23. When the current It increases and enters a current region Ib (second current region), the FET 24*a* operates so as to reduce the current I3 due to voltage drop by the resistor 24*c* and the resistor 24*b*. At this time, the current I2 flows through the second light-emitting circuit 42. In the current region Ib, "It =I2+I3" is fulfilled. When the current It further increases, the voltage drop by the resistor 24*b* increases and the FET 24*a* cuts off the current. As a result, in a current region Ic (third current region), all the current It flowing into the second light-emitting circuit 42 will flow through the second LED group 22.

Figure 5:
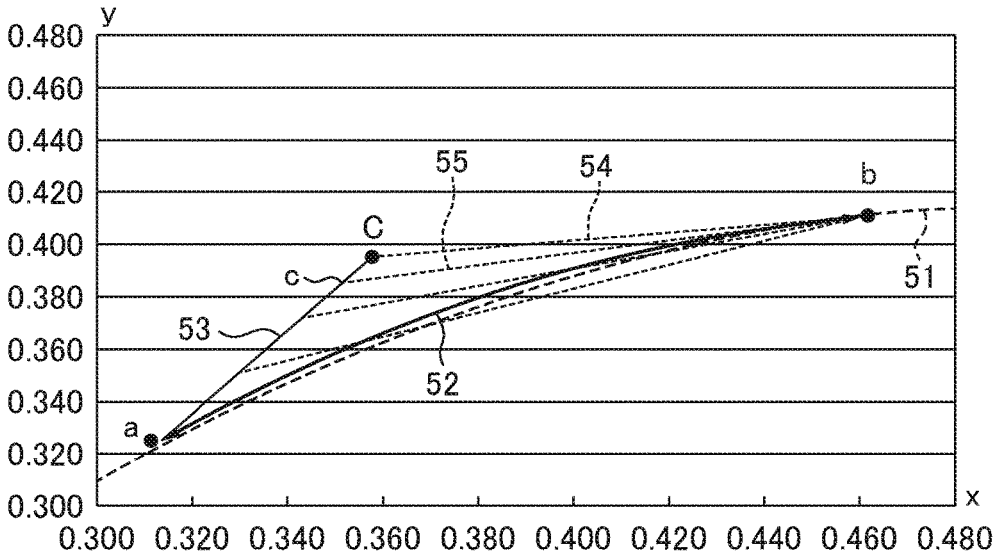
FIG. 5 is a graph illustrating a light emission characteristic of the LED module 10.

FIG. 5 is a graph illustrating a light emission characteristic of the LED module 10. In FIG. 5, an emission color of the LED module 10 is drawn on the CIE chromaticity diagram, and the vertical axis x and the horizontal axis y in FIG. 5 are chromaticity coordinates. In this figure, the blackbody radiation locus 51 is indicated by a dotted line, and the emission color 52 of the LED module 10 is indicated by a solid line.

In the LED module 10, the emission color of the first light-emitting circuit 41 is a chromaticity point b. In contrast, the emission color of the second light-emitting circuit 42 varies on a line segment 53 according to an extent of dimming. In this instance, a chromaticity point C is an emission color of the third LED group 23, and a chromaticity point a is an emission color of the second LED group 22.

When the LED module 10 is dimmed to low brightness, the second light-emitting circuit 42 emits light at the chromaticity point C. In other words, the current It flowing into the LED module 10 is within the range of the current region Ia, and the third LED group 23 is turned on while the second LED group 22 is turned off. In this instance, when the current It is given within the range of the current region Ia, a current I1 corresponding to this current It is supplied to the first light-emitting circuit 41. By adjusting the emission intensity (the value of the current I1) of the first light-emitting circuit 41 in this way, the emission color 52 of the LED module 10 is varied on a line segment 54 connecting the chromaticity points C and b. The line segment 54 preferably has a slope approximate to a tangential line of the blackbody radiation locus 51 passing through the chromaticity point b. The reason is that when the current It is in the range of the current region Ia, the line segment 54 is preferably as close as possible to the blackbody radiation locus 51.

When the LED module 10 is dimmed to intermediate brightness, the second light-emitting circuit 42 emits light at a chromaticity point on the line segment 53. In other words, the current It flowing into the LED module 10 is within the current region Ib, and both of the third LED group 23 and the second LED group 22 are turned on. In this instance, the emission intensity of the first LED group 21 is adjusted so that the emission color 52 of the LED module 10 is set to be a chromaticity point on the blackbody radiation locus 51. For example, when the second light-emitting circuit 42 emits light at a chromaticity point c, the first light-emitting circuit 41 emits light in an intensity such that the emission color 52 of the LED module 10 is an intersection of the blackbody radiation locus 51 and a line segment 55 connecting the chromaticity points c and b.

When the LED module 10 is adjusted to high brightness, the second light-emitting circuit 42 emits light at the chromaticity point a. In other words, the current It flowing into the LED module 10 is within the current region Ic, and the second LED group 22 is turned on while the third LED group 23 is turned off. In this instance, the first LED group 21 is turned off, and dimming is carried out, with the emission color 52 of the LED module 10 being the chromaticity point a.

Since the emission color of the second light-emitting circuit 42 linearly varies between the third color and the second color on the chromaticity diagram, the LED module 10 can emit light at an arbitrary chromaticity point in a region surrounded by the first color, the second color, and the third color on the chromaticity diagram, by adjusting the amount of light emitted from the first light-emitting circuit 41. Therefore, the emission color of the LED module 10 can be moved along the blackbody radiation locus 51, by setting the first and second colors to be the chromaticity points on the blackbody radiation locus 51, and the third color to be a chromaticity point the x coordinate of which is between those of the first and second colors and the y coordinate of which is higher than that of the blackbody radiation locus 51.

As described above, when the LED module 10 is dimmed to low brightness, its emission color 52 is varied linearly on the line segment 54 depending on the emission intensity. Further, when the LED module 10 is dimmed to intermediate brightness, the chromaticity point of its emission color 52 may be slightly shifted from the blackbody radiation locus 51 in order to carry out smooth dimming of the module (for example, in order to avoid a situation such as increase in light emission intensity due to forcible adjustment of the light emission color 52 to the blackbody radiation locus 51 when the module is attempted to be dimmed to low brightness).

Although in the LED module 10, the numbers of the series stages of the first, second, and third LED groups 21, 22, and 23 are 18, 18, and 16, respectively, they may be appropriately varied, depending on specifications of the variable current sources and a forward drop voltage of the LED die 16 among others. Although only the LEDs 21*a* are included in the first LED group 21, plural kinds of LEDs having different emission colors may be combined to yield a desired emission color. This also applies to the second and third LED groups 22 and 23. In this instance, the LEDs 22*a* and other LEDs may not include phosphor, or each LED may be configured by plural LED dies incorporated in one package. In addition, the LED die may be a monolithic IC having plural light-emitting units.

The width and position of the current region Ib can be adjusted by the values of the resistors 24*b* and 24*c* and the ratio of the one value to the other. When the value of the resistor 24*b* is increased, the current region Ib shifts leftwardly in FIG. 4. When the value of the resistor 24*c* is increased with respect to the resistor 24*b*, the width of the current region Ib widens. When the resistor 24*c* is removed, the current region Ib is determined only by the characteristics of the FET 24*a*.

In the LED module 10, the emission color of the third LED group 23 (chromaticity point C) is away from the blackbody radiation locus 51, but the chromaticity point C may be brought closer to the blackbody radiation locus 51. In this instance, the current region Ib of the graph illustrated in FIG. 4 also need be adjusted together.

Further, the light emission color of the first LED group may be the chromaticity point a, and that of the third LED group may be the chromaticity point b. In this instance, the brightness of the entire lighting device will be adjusted by using the first LED group, and the emission color thereof will be corrected by using the second and third LED groups. Such separation of the portion responsible for the brightness from that responsible for the correction facilitates setting of the light emission state of the device.

As described above, since the LED module 10 simultaneously varies the amount and color of the light emission of the second light-emitting circuit 42 according to the current It, two variable constant-current sources 45 and 46 for controlling output current suffice when it varies emission color 52 curvilinearly along the blackbody radiation locus 51 during dimming operation. Further, the second light-emitting circuit 42 controls its current value to vary simultaneously the brightness and the emission color between the second and third colors, and the first light-emitting circuit 41 only links this current value with the light-emitting amount of the first LED group 21. There is a one-to-one correspondence between the current It and the current I1 flowing through the first light-emitting circuit 41, and therefore a lighting device using the LED module 10 allows simplification of its control program.

Figure 6:
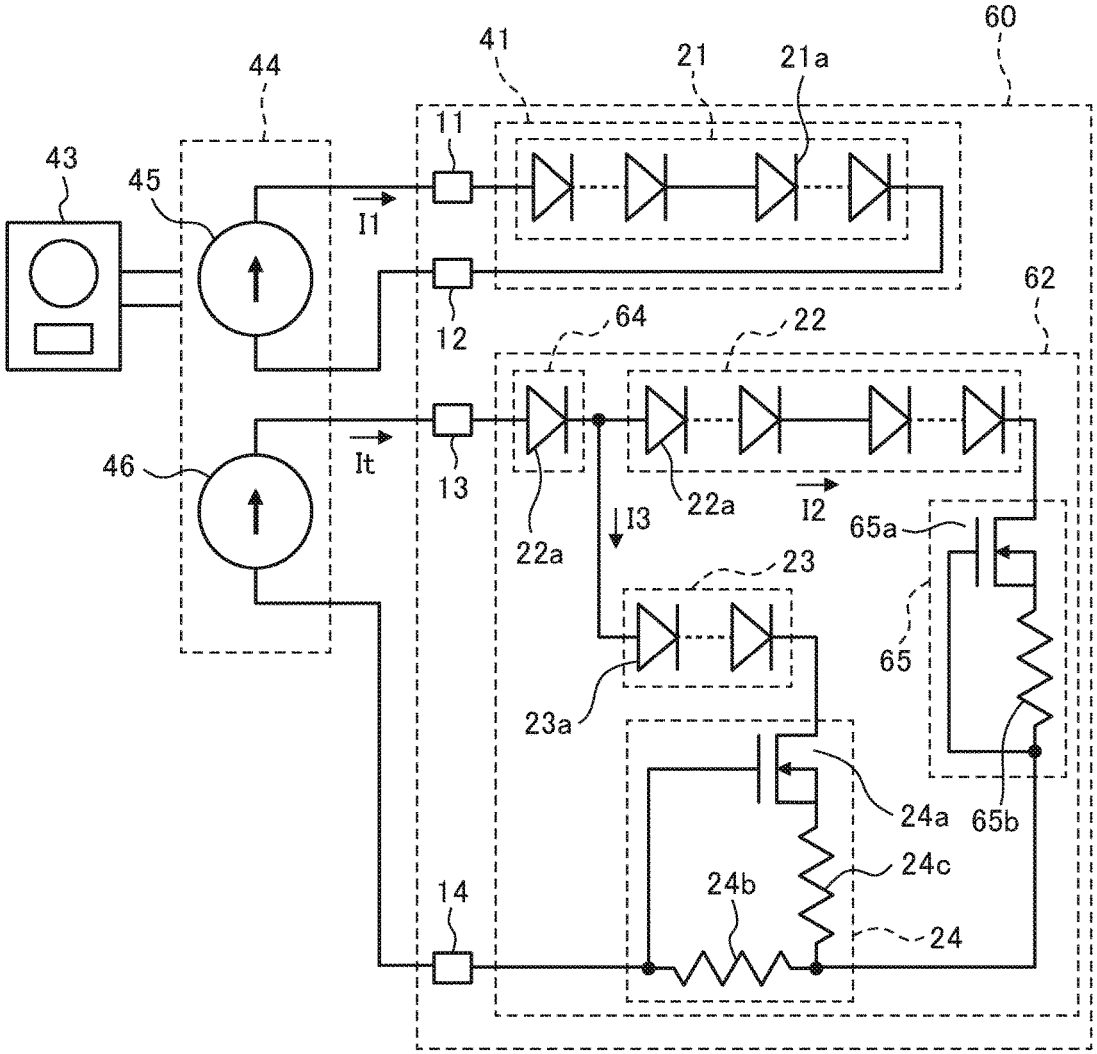
FIG. 6 is a circuit diagram of another LED module 60.
Figure 7:
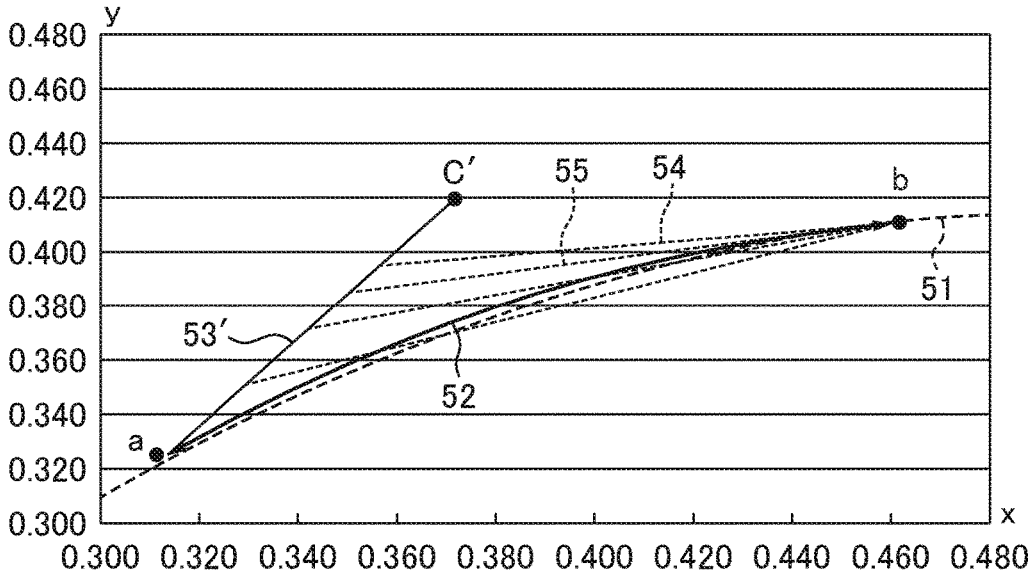
FIG. 7 is a graph illustrating a light emission characteristic of the LED module 60.
Figure 8:
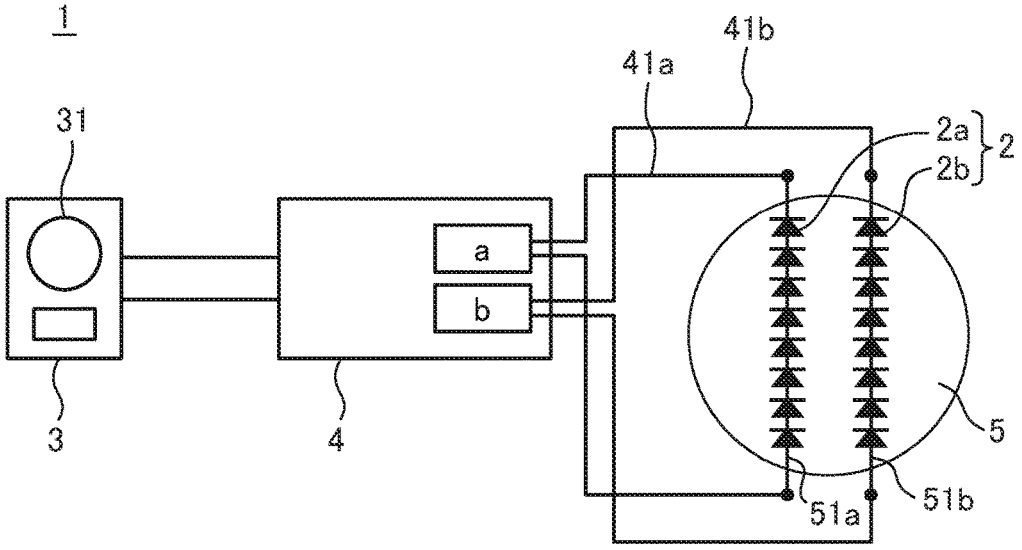
FIG. 8 PRIOR ART
FIG. 8 is a circuit diagram of a lighting device (light-emitting device 1) described in Patent Literature 1.
Figure 9:
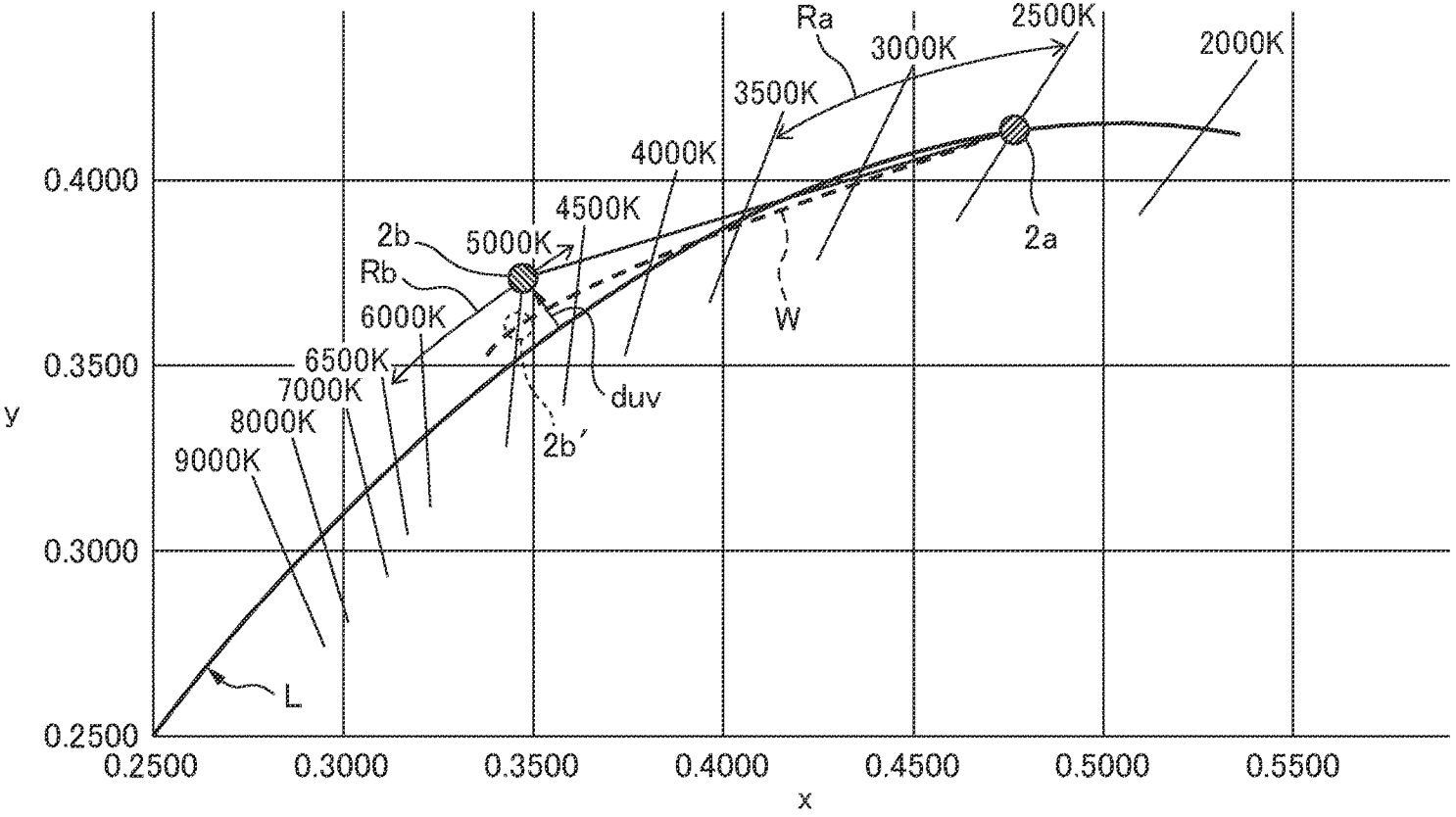
FIG. 9 PRIOR ART
FIG. 9 is a graph illustrating a light emission characteristic of the light-emitting device 1 illustrated in FIG. 8.

FIG. 6 is a circuit diagram of another LED module 60, and FIG. 7 is a graph illustrating a light emission characteristic of the LED module 60. Since the configuration and operation of the LED module 60 are basically the same as those of the LED module 10 illustrated in FIGS. 1 to 5, only differences will be described below.

As illustrated in FIG. 6, the LED module 60 includes a second light-emitting circuit 62 which is the circuit in the LED module 10 illustrated in FIG. 3 and includes additionally a fourth LED group 64 and a current-limiting circuit 65. The fourth LED group 64 is a circuit in which one or more LEDs 22*a* are connected in series, and is inserted between the electrode 13 and a connection point of the second LED group 22 and the third LED group 23. The current-limiting circuit 65 includes a depletion-type FET 65*a* and a resistor 65*b*, and is provided between the second LED group 22 and the current detection resistor 24*b* (first current path). The current-limiting circuit 65 protects the second light-emitting circuit 62 from overcurrent.

The fourth LED group 64 is turned on when the LED module 60 is adjusted to high brightness (the second LED group 22 is turned on and the third LED group 23 is turned off) and when the LED module 60 is dimmed to intermediate brightness (both of the second LED group 22 and the third LED group 23 are turned on). As a result, in the LED module 60, utilization efficiency of the LEDs 22*a* can be improved as compared with the LED module 10. Note that the utilization efficiency of the LEDs 22*a* is compared under the condition that the sum of the number of the series stages of the second LED group 22 and that of the fourth LED group 64 in the LED module 60 is equal to that of the second LED group 22 in the LED module 10. In the LED module 60, not only the number of series stages of the third LED group 23 is appropriately adjusted (decreased), but also the emission color of the LEDs 23*a* included in the third LED group 23 is altered (see FIG. 7).

As illustrated in FIG. 7, in the LED module 60, the emission color of the third LED group 23 (chromaticity point C') is shifted from that of the third LED group 23 of the LED module 10 (chromaticity point C). In other words, in FIG. 7, the line segment 53 illustrated in FIG. 5 is extended upward (line segment 53') and its end is determined as the chromaticity point C'. When the LED module 60 is dimmed to low brightness (the second LED group 22 is turned off and the third LED group 23 and the fourth LED group 64 are turned on), the second light-emitting circuit 62 emits light at a chromaticity point on an intersection of the line segment 53' and the line segment 54 (chromaticity point C in FIG. 5).

The preceding description is merely to illustrate and describe exemplary embodiments of the present invention. It is not intended to be exhaustive or limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, the invention is not limited to the particular embodiment disclosed as the best mode contemplated for carrying out this invention, but the invention includes all embodiments falling within the scope of the claims. The invention may be practiced otherwise than is specifically explained and illustrated without departing, from its spirit or scope.

What is claimed is:

1. An LED module comprising:

a circuit board;

a first light-emitting circuit which comprises a first LED group emitting light in a first color, and is mounted on the circuit board;

a second light-emitting circuit which comprises a second LED group emitting light in a second color, a third LED group emitting light in a third color, a switch element, and a current detection element, and is mounted on the circuit board; and a first electrode, a second electrode, a third electrode, and a fourth electrode which are formed on the circuit board, wherein the second light-emitting circuit comprises a first current path through which a current output from the second LED group is input to one end of the current detection element, and a second current path through which a current output from the third LED group passes via the switch element and is input to one end of the current detection element, the first electrode and the second electrode are connected to the first light-emitting circuit, the third electrode is connected to the second LED group and the third LED group, the fourth electrode is connected to the other end of the current detection element, a threshold voltage for light emission of the second LED group is set to be larger than a threshold voltage for light emission of the third LED group, and the switch element controls a current flowing through the second current path in accordance with a current flowing via the current detection element.

2. The LED module according to claim 1, wherein in the second light-emitting circuit, when a supply current supplied between the third electrode and the fourth electrode is in a first current region, a current flows only through the second current path, so that only the third LED group is turned on, when the supply current is in a second current region larger than the first current region, the current flows through the first current path and the second current path, so that both of the second LED group and the third LED group are turned on, and when the supply current is in a third current region larger than the second current region, the current flowing through the second current path is limited by the switch element, and thereby the current flows only through the first current path, so that only the second LED group is turned on.

3. The LED module according to claim 1, wherein the first color and the second color has a chromaticity point which is on a blackbody radiation locus, and the third color has a chromaticity point an x coordinate of which is between that of the chromaticity point of the first color and that of the chromaticity point of the second color and a y coordinate of which is higher than that of the blackbody radiation locus.

4. The LED module according to claim 1, wherein a fourth LED group is inserted between the third electrode and a connection point of the second LED group and the third LED group.

5. The LED module according to claim 1, further comprising a current-limiting circuit provided between the second LED group and the current detection element in the first current path.

6. The LED module according to claim 1, further comprising a resistor provided between the switch element and the current detection element in the second current path.

7. A method of controlling the LED module according to claim 2, comprising:

inputting, when the supply current is in the first current region, a current in an amount corresponding to the supply current to the first light-emitting circuit, so that the first LED group emits light;

circulating, when the supply current is in the second current region, a current through the first light-emitting circuit, the current driving the first LED group to emit light at an intensity such that an emission color of the LED module is on an intersection of the blackbody radiation locus and a line segment connecting chromaticity points of the first color and an emission color of the second light-emitting circuit in a chromaticity diagram; and decreasing, when the supply current is in the third current region, the current flowing through the first light-emitting circuit, so that the first LED group is turned off.

* * * * *